US009093000B2

(12) United States Patent
Cassidy et al.

(10) Patent No.: US 9,093,000 B2
(45) Date of Patent: Jul. 28, 2015

(54) PRODUCT CENTRIC MERCHANDISER

(71) Applicants: Design Display Group, Inc., Carlstadt, NJ (US); Frank Brunkhorst Co., LLC, Sarasota, FL (US)

(72) Inventors: Michael Cassidy, Hoboken, NJ (US); Andrew Jones, Bradenton, FL (US)

(73) Assignees: DESIGN DISPLAY GROUP, INC., Carlstadt, NJ (US); FRANK BRUNKHORST CO., LLC, Sarasota, FL (US)

( * ) Notice: Subject to any disclaimer, the term of this patent is extended or adjusted under 35 U.S.C. 154(b) by 0 days.

(21) Appl. No.: 14/095,357

(22) Filed: Dec. 3, 2013

(65) Prior Publication Data

US 2015/0154895 A1 Jun. 4, 2015

(51) Int. Cl.
*G09F 15/00* (2006.01)
*G09F 7/18* (2006.01)

(52) U.S. Cl.
CPC ..... *G09F 7/18* (2013.01); *G09F 2007/1873* (2013.01)

(58) Field of Classification Search
CPC ... E04H 13/003; G09F 15/00; G09F 15/0012; G09F 7/00; G09F 7/18
USPC ..... 40/606.01; 248/274.1
See application file for complete search history.

(56) References Cited

U.S. PATENT DOCUMENTS

| | | | | |
|---|---|---|---|---|
| 3,982,342 | A | 9/1976 | Moore | |
| 4,372,066 | A | 2/1983 | Slavsky, Sr. | |
| 5,718,072 | A * | 2/1998 | Garfinkle | 40/607.13 |
| 6,003,827 | A * | 12/1999 | Kulp et al. | 248/534 |
| 6,032,910 | A * | 3/2000 | Richter | 248/274.1 |
| 6,530,166 | B1 * | 3/2003 | Garfinkle et al. | 40/606.14 |
| 6,901,698 | B2 * | 6/2005 | Manning | 47/48.5 |
| 7,320,450 | B2 * | 1/2008 | Carnevali | 248/160 |
| 7,481,404 | B2 * | 1/2009 | Carnevali | 248/160 |
| 7,562,849 | B2 * | 7/2009 | Pitcher et al. | 248/158 |
| 7,959,116 | B2 * | 6/2011 | Carnevali | 248/177.1 |
| 8,220,189 | B2 * | 7/2012 | Makhija et al. | 40/606.14 |
| 8,220,763 | B2 * | 7/2012 | Lewis | 248/311.2 |
| 2008/0307684 | A1 * | 12/2008 | Ulloa et al. | 40/607.1 |
| 2013/0074387 | A1 * | 3/2013 | Makhija et al. | 40/606.14 |

OTHER PUBLICATIONS http://www.siegeldisplay.com/App_Themes/SiegelDisplay/ProductImages/ZoomImg/sm85mblack-I.jpg.
http://www.displays2go.com/Filter?o-1-27739-3-122.
http://www.displays2go.com/C-27798/Plastic-Price-Tag-for-Store-Use.

* cited by examiner

*Primary Examiner* — Shin Kim
(74) *Attorney, Agent, or Firm* — Cozen O'Connor

(57) ABSTRACT

A product merchandiser which can be adjusted to position the sign based on the size and shape of the particular product being merchandised, and on the space available on the shelf or counter in view of the proximity of the other products, such that the product information, e.g., product name and price, is clearly visible and associated with the product being merchandised.

14 Claims, 19 Drawing Sheets

PRODUCT CENTRIC MERCHANDISER

This invention relates generally to sign arrangements used in connection with merchandising products and, more particularly, to such merchandisers which are situated on a shelf or counter in proximity to a product which display product and price information. Such sign arrangements are referred to herein as "product merchandisers."

BACKGROUND OF THE INVENTION

Product merchandisers which display product and price information constructed to be situated in proximity to products are in widespread use, such as in department stores, specialty stores, warehouse stores, pet stores and grocery stores, among other establishments. One type of product merchandiser comprises a base adapted to rest on a shelf or counter, a vertical post having one end fixed to the base, and a sign connected to the other end of the base having product and pricing information. The prior art product merchandiser is situated on the counter proximate to the product.

One problem with conventional product merchandisers is that the size and shape of products widely vary and while a product merchandiser may be useful with a small product, it may not be sufficiently tall for use with a larger product. This problem often arises in connection with the use of conventional product merchandisers in deli cases in which meats, such as ham, sausage and cold cuts, cheeses, chicken, salads and other food products are displayed in proximity with each other. A product merchandiser may be effective for use with a large ham but be too tall for use with cold cuts.

Another problem with conventional product merchandisers occurs when a shelf or counter is crowded with many products in close proximity to each other. First, there may not be space on the counter or shelf to place the bases of a plurality of product merchandisers proximate to closely spaced products. Second, when the sizes and shapes of the products widely vary, it is difficult to situate a product merchandiser proximate to a respective product, and in a location at which the sign can be easily seen by consumers, and in which the sign will not itself obstruct other products and their product merchandisers. These problems are not uncommon in deli cases.

SUMMARY OF THE INVENTION

It is an object of the present invention to provide a new and improved product merchandiser.

It is another object of the present invention to provide a new and improved merchandiser which is adjustable for use with products having different sizes and shapes, i.e., a "product centric merchandiser."

It is a further object of the present invention to provide a new and improved product centric merchandiser which is adjustable to position a sign in any desired location proximate to a product.

It is still another object of the present invention to provide a new and improved product merchandiser which is effective for use in situations in which a shelf or counter is crowded with products in close proximity to each other.

Briefly, these and other objects are attained by providing a product merchandiser which is "product centric," i.e., a product merchandiser which can be adjusted to position the sign based on the size and shape of the particular product being merchandised, and on the space available on the shelf or counter in view of the proximity of the other products, such that the product information, e.g., price, is clearly visible and associated with the product being merchandised.

A product centric merchandiser according to the invention includes a base, a flexible shape-retaining elongate member which is bendable and/or twistable with respect to its longitudinal axis and which retains its shape after bending, and a sign assembly connected to an end portion of the shape-retaining elongate member. The coupling between the flexible, shape-retaining elongate member and base is structured and arranged so that the elongate member is connectable to the base at different selectable positions along the length of the flexible, shape-retaining elongate member. In this manner, a post portion of the elongate member extending between the base and the sign is defined, the length of which is adjustable based on the various positioning factors discussed above.

In use, the product centric merchandiser rests on a counter or shelf and a product to be merchandised is preferably situated on the base of the merchandiser. The flexible, shape-retaining elongate member is connected to the base at a position selected such that the length of the post portion of the elongate member between the base and the sign assembly is suitable, based on the size and shape of the product, and the proximity of other products, to enable the post portion of the elongate member to be bent and/or twisted into a position in which the sign assembly is situated at a desired location proximate to the product.

The base of the product centric merchandiser is preferably designed to facilitate situating the product on the base. This is advantageous since the weight of the product on the base helps to prevent the merchandiser from tipping over when the sign assembly is not situated vertically over the base.

In a preferred embodiment, the shape-retaining elongate member is a strip-shaped member formed of plastic having a pair of beaded side portions extending along its side edges in which metallic wires are situated.

In another preferred embodiment, the base and flexible shape-retaining elongate member are coupled to each other by a slot structure formed in the base in which the shape-retaining elongate member is received in a sliding friction fit.

DESCRIPTION OF THE DRAWINGS

A more complete appreciation of the present invention and many of the attendant advantages thereof will be readily understood by reference to the following drawings in which.

DESCRIPTION OF THE PREFERRED EMBODIMENTS

Figure 1:
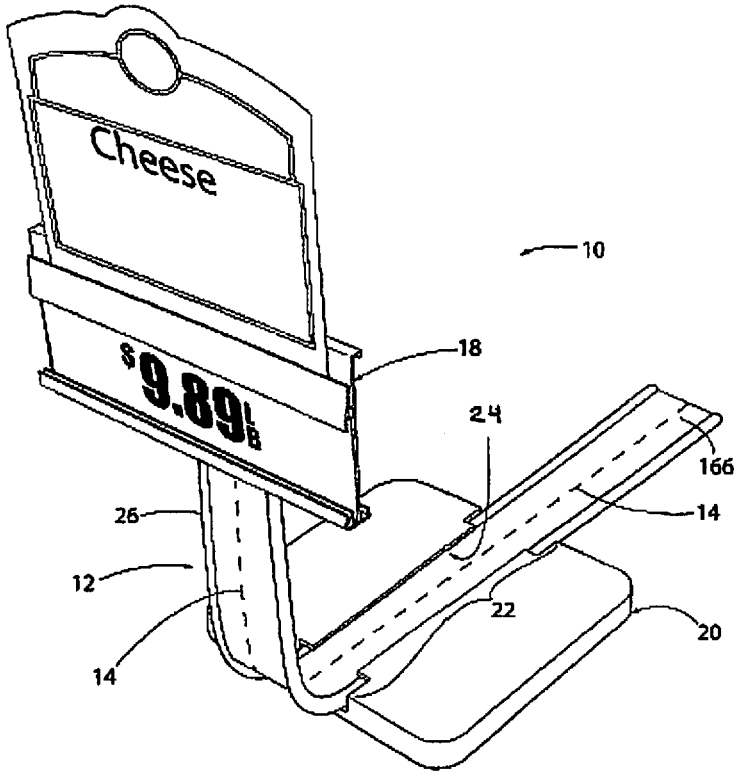
FIG. 1 is a top right perspective view of one embodiment a product centric merchandiser according to the present invention in which the flexible shape-retaining elongate member is shaped (e.g., bent and/or twisted) to position the sign assembly in front of a product (not shown)
Figure 2:
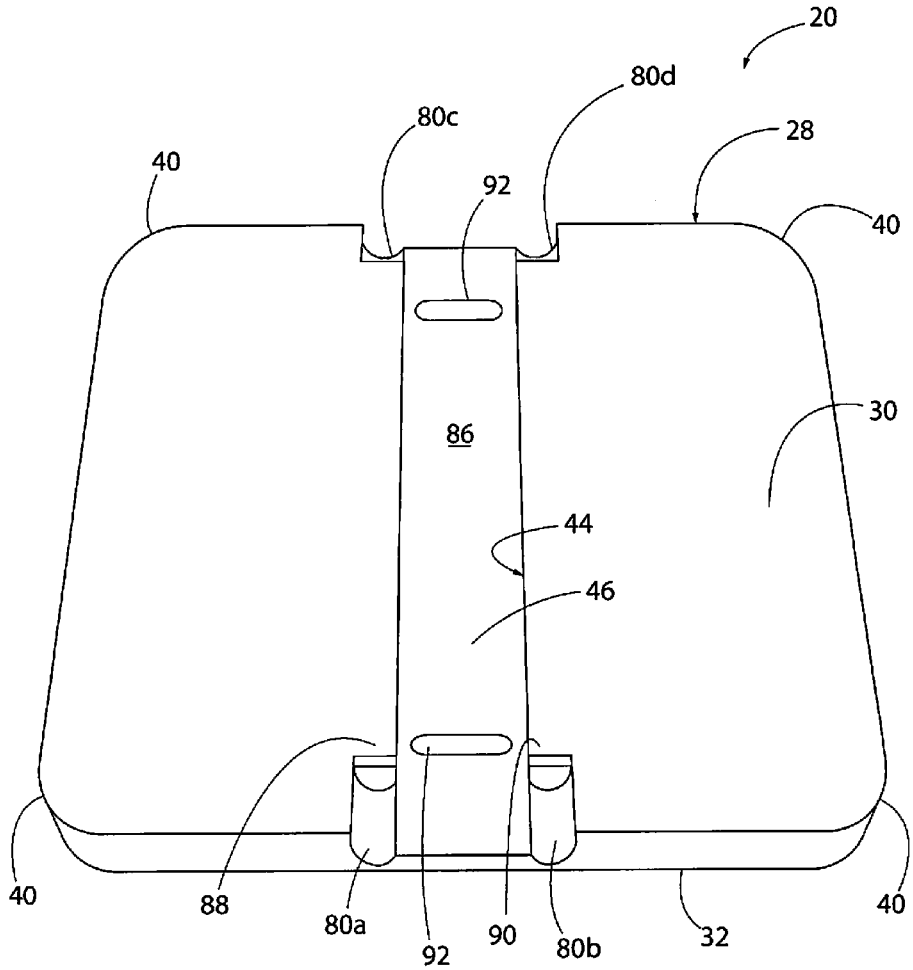
FIG. 2 is a top front perspective view of the base of the embodiment of FIG. 1.
Figure 3:
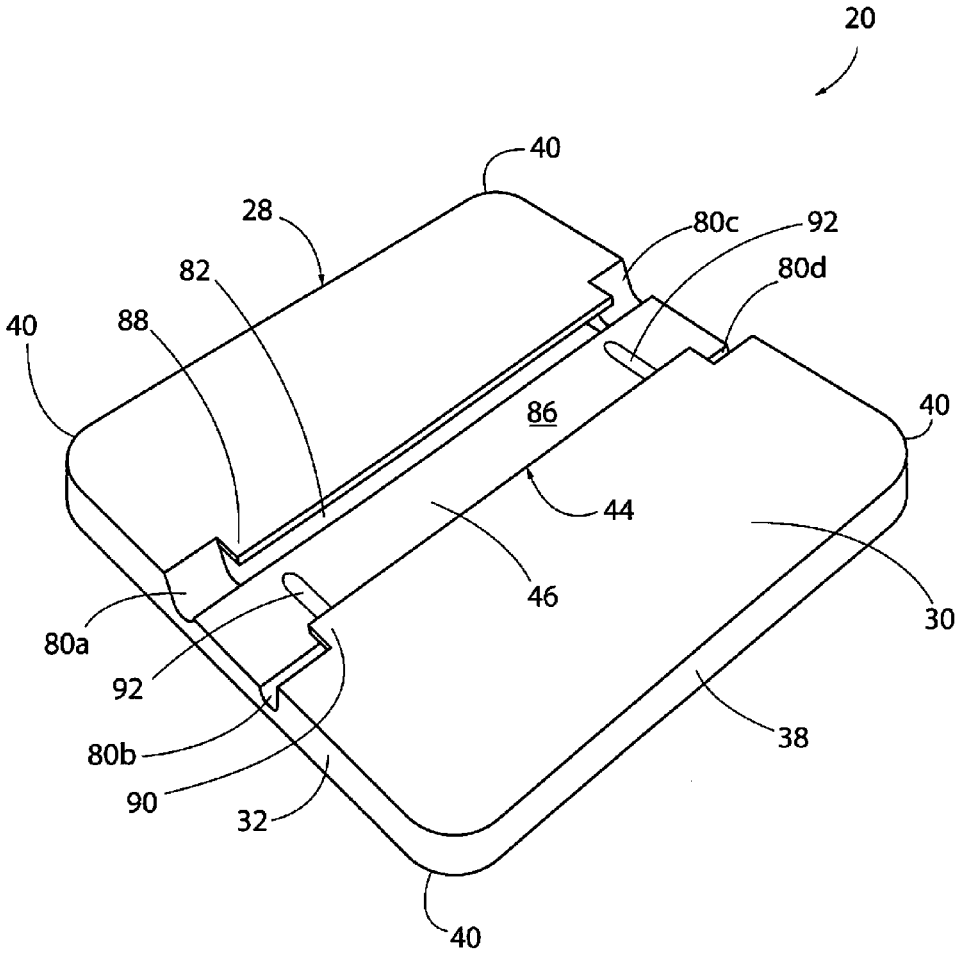
FIG. 3 is top right perspective view of the base of the embodiment of FIG. 1.
Figure 4:
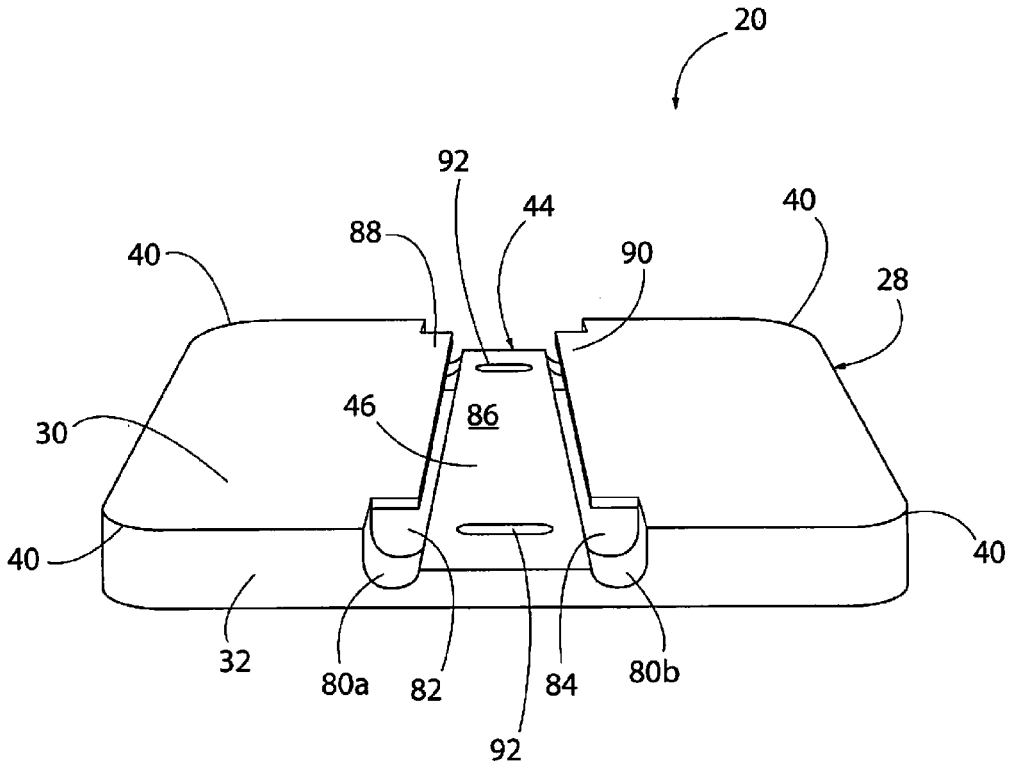
FIG. 4 is a front edge perspective view of the base of the embodiment of FIG. 1.
Figure 5A:
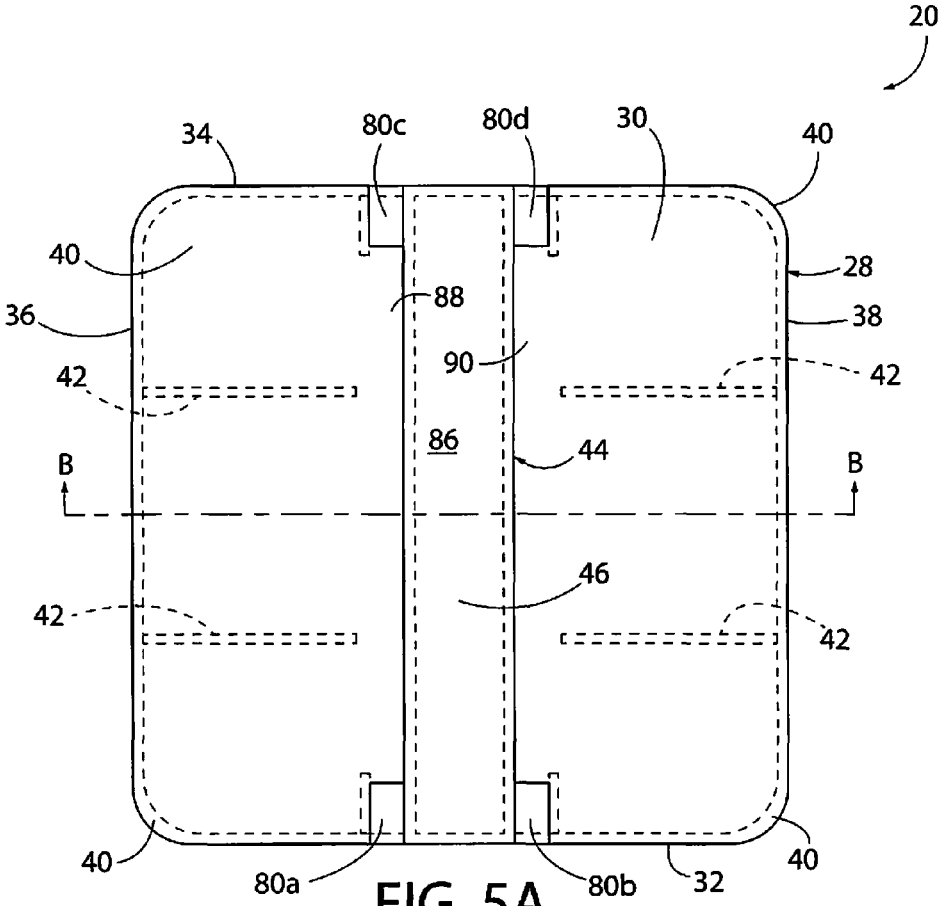
FIG. 5*a* is a top plan view of the base of the embodiment of FIG. 1.
Figure 5B:
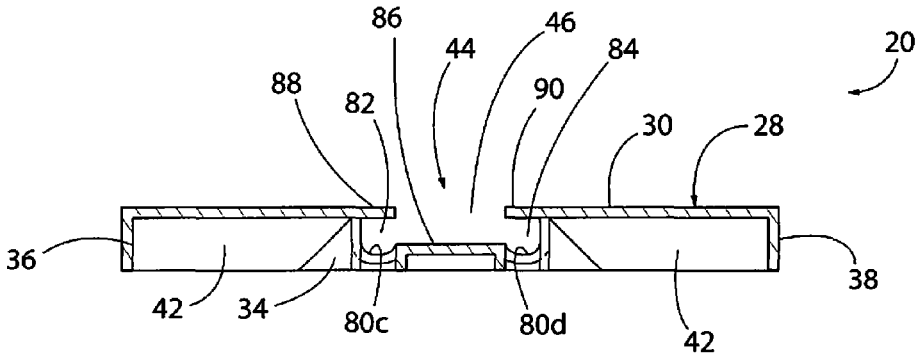
FIG. 5*b* is a section view taken along line B-B of FIG. 5*a;*

Referring now to the drawings wherein like reference characters designate identical or corresponding parts throughout the several views, and more particularly to FIG. 1, one embodiment of a product centric merchandiser in accordance with the invention is designated 10. The product centric merchandiser 10 includes a flexible shape-retaining elongated member 12 having a longitudinal axis 14 (shown in dotted lines) and a pair of longitudinal end portions 16*a* (not shown), 16*b*. A sign assembly 18 is coupled to end portion 16*a* of the flexible shape-retaining elongate member 12. A base 20 is connected to the flexible shape-retaining elongate member 12 at a connection region 22.

Figure 18:
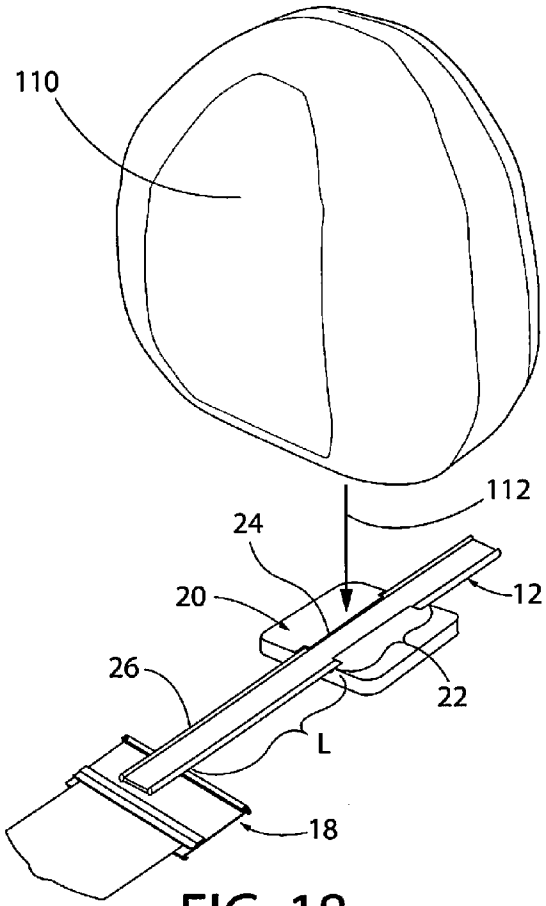
FIG. 18 is a perspective view illustrating a step in associating a food product with the embodiment of the product centric merchandiser of FIG. 1 oriented so that the flexible shape-retaining elongate member can be shaped to position the sign assembly in front of the product.

Referring to FIG. 1 in conjunction with FIG. 18, the flexible shape-retaining elongate member 12 and base 20 are connected to each other at the connection region 22 of the flexible shape-retaining elongate member 12 by a connection arrangement 24 such that a post portion 26 of the flexible shape-retaining elongate member 12 extends from the base 20 and has a certain length L defined between the base 20 and the sign assembly 18.

As described in greater detail below, the connection arrangement 24 is configured such that the flexible shape-retaining elongate member 12 and base 20 are connectable to each other at any one of a plurality of possible connection regions 22 along the length of the flexible shape-retaining elongate member 12. Each of the post portions 27 defined by a respective connection region 22 has a certain length L between the base 20 and sign assembly 18 which is different from the length L of a post portion 26 defined by a different connection region 22. In other words, the length L of the post portion 26 can be increased or decreased by adjusting the position of the connection region 22 of the flexible shape-retaining elongate member 12 to the base 20.

Referring to FIGS. 2-4, 5*a* and 5*b*, the base 20 of the embodiment of the product centric merchandiser of FIG. 1 is molded of plastic and comprises a substantially square (see FIG. 5*a*) body 28 having an upper substantially planar support surface 30 from which a front wall 32, a rear wall 34, and side walls 36, 38 depend perpendicularly to the plane of the upper support surface 30. The walls 32, 34, 36 and 38 have the same relatively short height. For example, the body 28 of base 20 may be 3.750 inches square and the walls 32, 34, 36, 38 may be 0.368 inches high. The corners 40 of the base body 28 are rounded.

In use, as described in greater detail below, a product is associated with the product centric merchandiser, by first situating the base 20 on a counter or the like, with the plane of the upper support surface 20 being substantially horizontal. The product being merchandised is situated on the upper surface 30 of base 20 at least in part. Ribs 42 (FIGS. 5*a* and 5*b*) are formed on the underside of the upper surface 30 which are of a height equal to the height of the walls of the base to provide additional support for the upper support surface 20 when a product to be merchandised is associated with the product centric merchandiser 10.

As also discussed in greater detail below, a slot structure 44 formed on the base 20 defining a slot 46 constitutes a part of the connection arrangement 24 by which the flexible shape-retaining elongate member 12 is connected to the base 20.

Figure 6:
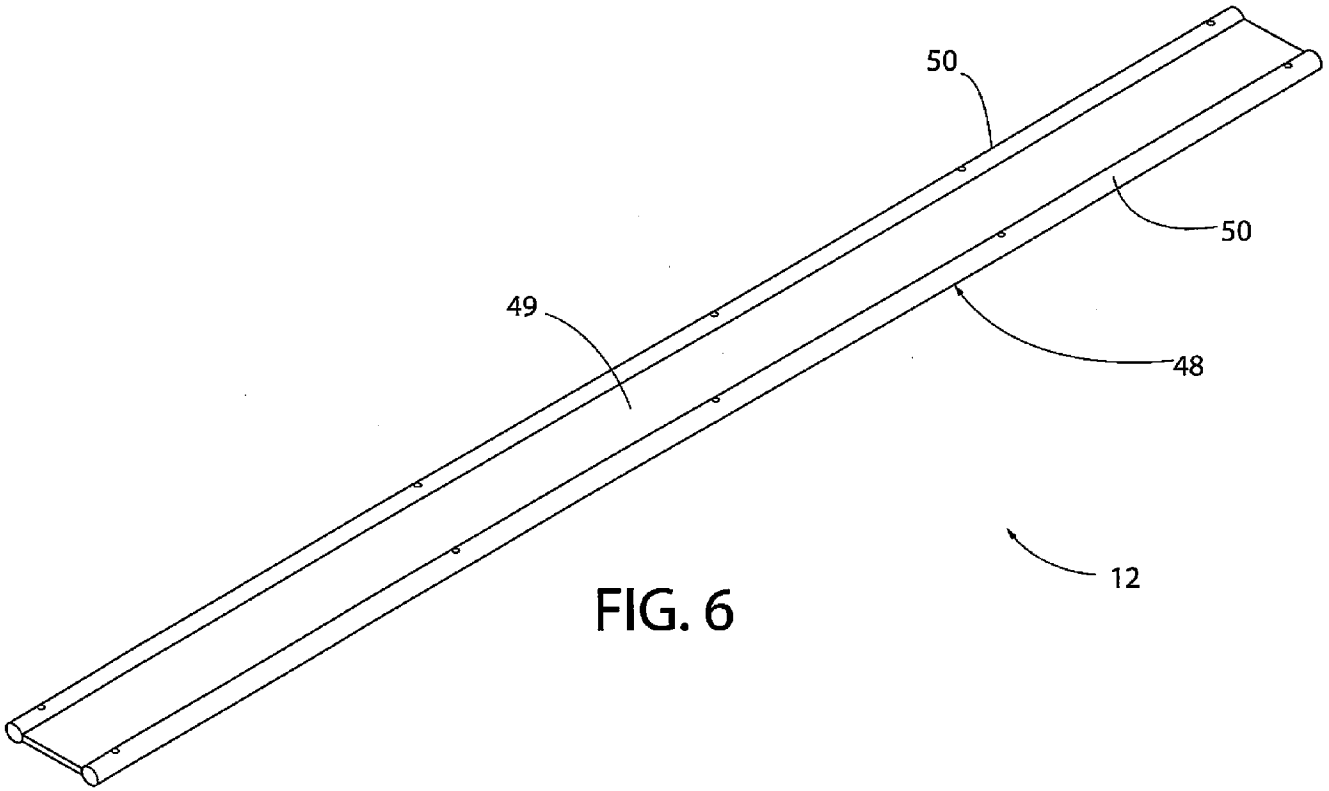
FIG. 6 is a perspective view of the flexible shape-retaining elongate member of the embodiment of FIG. 1.
Figure 7A:
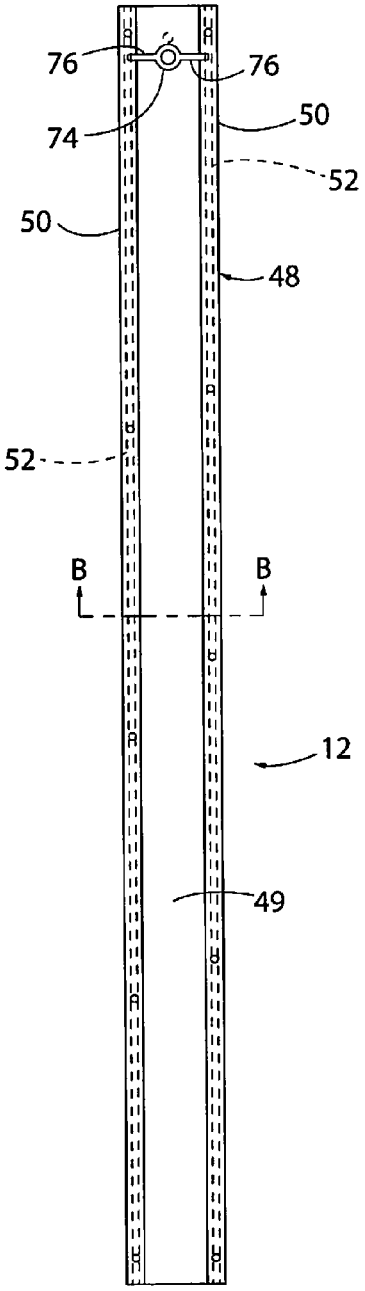
FIG. 7*a* is a bottom plan view of the flexible shape-retaining elongate member of the embodiment of FIG. 1.
Figure 7B:
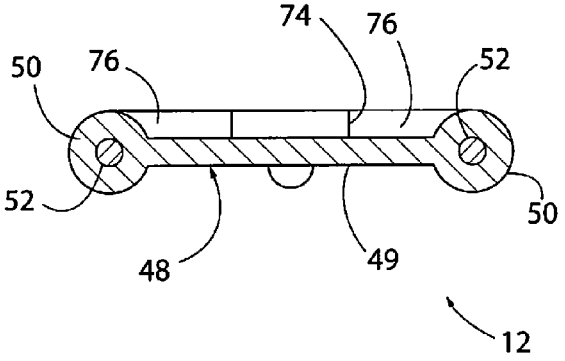
FIG. 7*b* is a section view taken along line B-B of FIG. 7*a;*

Referring now to FIGS. 6, 7*a* and 7*b*, the flexible shape-retaining elongate member 12 of the embodiment of the product centric merchandiser 10 shown in FIG. 1 comprises a strip-shaped body 48 formed of low density polyethylene. The body 48 includes a web portion 49 having a pair of longitudinal elongated beaded side edge portions 50. A flexible metal wire 52 is situated within and extends longitudinally through each of the elongated beaded side edge portions 50 along the length of the body 48 of the flexible shape-retaining elongate member 12. Referring to FIGS. 7*a* and 7*b*, the flexible shape-retaining elongate member 12 of the embodiment of the product centric merchandiser 10 shown in FIG. 1 has a length of 13.125 inches, a width of 1.00 inch and a thickness of 0.060 inches. The web portion 49 has a width of 0.635 inches. Each beaded side edge portion 50 has a diameter of 0.188 inches and each wire 52 has a diameter of 0.0625 inches. The flexible shape-retaining elongate member 12 is bendable and/or twistable about its longitudinal axis 14 and retains its shape after being so bent and/or twisted.

Figure 8:
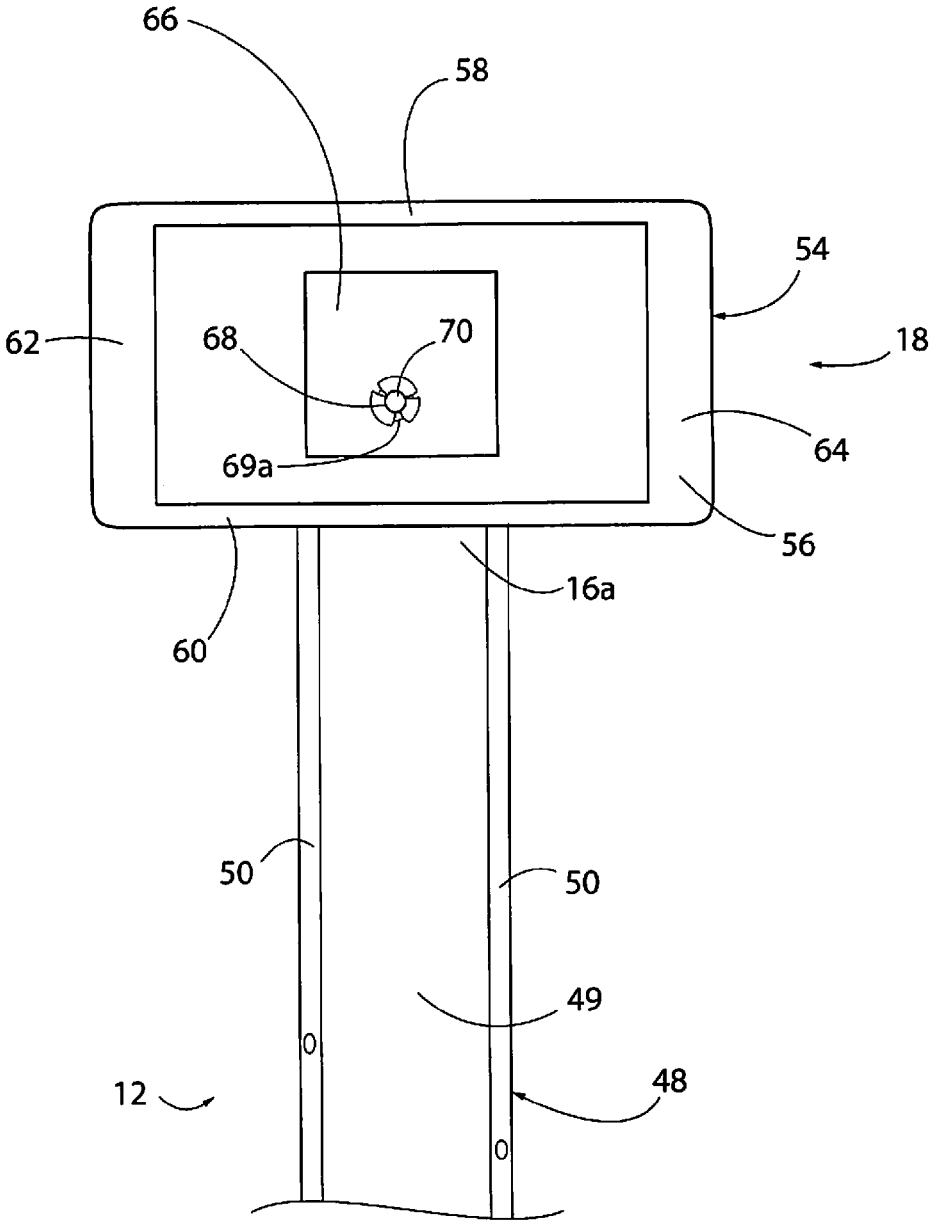
FIG. 8 is a top plan view of the bracket of the sign assembly coupled to an end portion of the flexible shape-retaining elongate member of the embodiment of FIG. 1.
Figure 9:
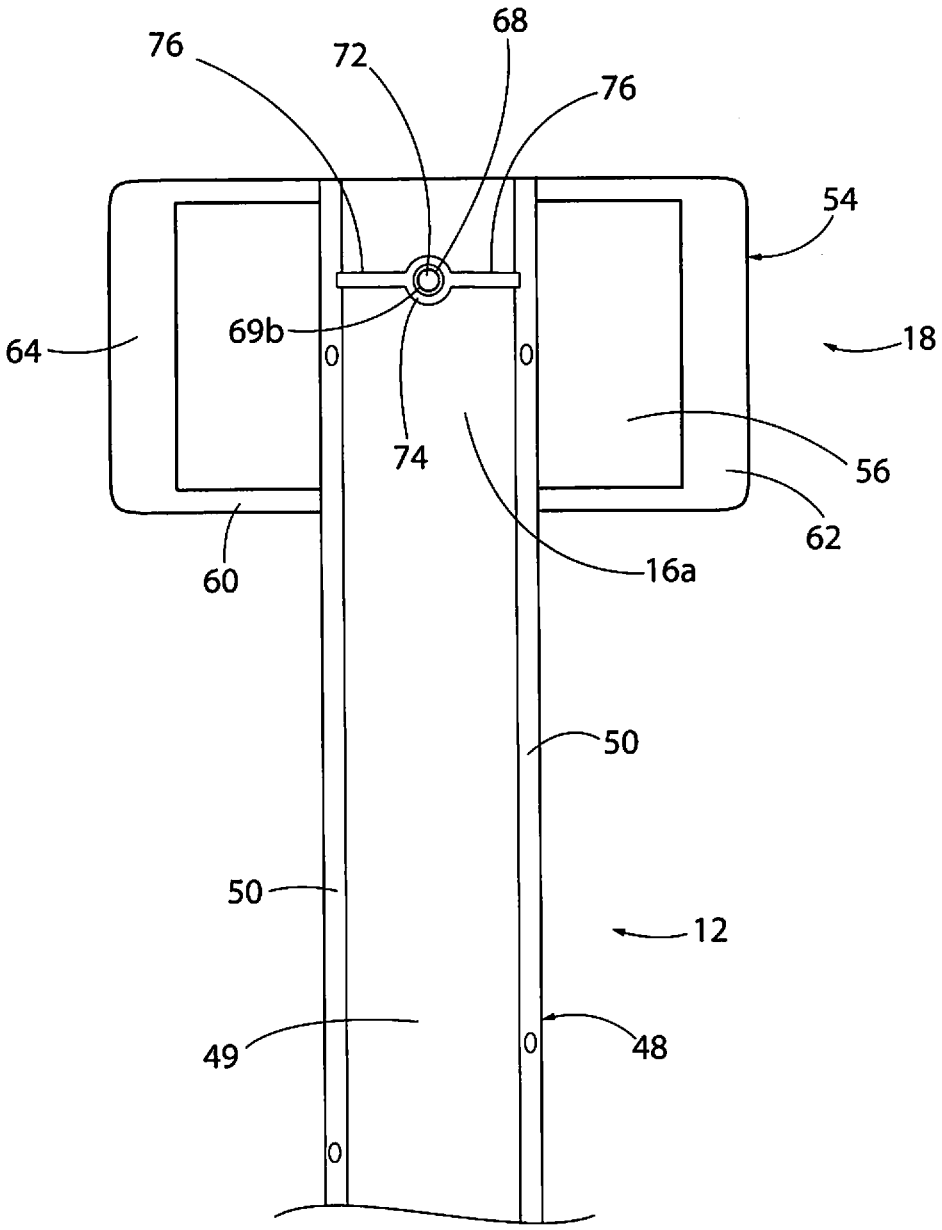
FIG. 9 is a bottom plan view of the bracket of the sign assembly coupled to an end portion of the flexible shape-retaining member of the embodiment of FIG. 1.

Referring to FIGS. 8 and 9, the sign assembly 18 of the embodiment of the product centric merchandiser 10 of FIG. 1 comprises a bracket member 54 which is rotatably connected to end portion 16*a* of the flexible shape-retaining elongate member 12. The bracket member 54 has a rectangular shape and includes a central body portion 56 surrounded by upper and lower flanges 58 and 60 and side edge portions 62 and 64. The body portion has a central recessed portion 66 which is connected to the web portion 49 of the longitudinal end portion 16*a* of the flexible shape-retaining elongate member 12 by a cylindrical metallic ferrule 68 having a body extending through aligned openings 69*a* and 69*b* formed in the central recessed portion 66 of bracket member 54 and the web portion 49 of the flexible shape-retaining elongate member 12. The ferrule 68 has front outwardly turned upset end 70 (FIG. 8) and a rear outwardly directed flange 72 (FIG. 9) to fix the cylindrical ferrule 68 in the aligned openings 69*a*, 69*b*. The ferrule 68 constitutes a shaft around which the bracket member 54 can rotate with respect to the flexible shape-retaining elongate member 12. The opening 69*b* in the web portion 49 is formed by a cylindrical wall 74 flanked by a pair of reinforcing ribs 76. The bracket member 54 has a friction relationship with the flexible shape-retaining elongate member 12 so that when the bracket member 54 is rotated to a particular position with respect to the elongate member 12, it will stay in that position until it is rotated to a different position.

The connection of the flexible shape-retaining elongate member 12 and the base 20 will now be described in greater detail. The flexible shape-retaining elongate member 12 has a transverse cross-sectional shape (see FIG. 7*b*) configured such that the elongate member 12 is slidingly received in the slot 46 in base 20 for movement in the direction of the longitudinal axis 14 (FIG. 1) of the elongate member 12. In particular, the transverse cross-section of the flexible shape-retaining elongate member 12 has a shape defined by the thin planar web portion 49 and the pair of enlarged beaded transverse side edge portions 50. The slot 46 in the base 20 is formed to extend below and parallel to plane of the upper support surface 30 of the base 20 and open onto the front and rear walls 32 and 34 of base 20. In this manner, the upper support surface 30 of base 20 remains planar without any obstructions which might otherwise hinder the placement of the product to be merchandised on the upper support surface 30.

The slot structure 44 includes a pair of facing hook-shaped wall sections 80*a*, 80*b* depending downwardly from the upper surface 30 of the base 20 opening onto the front base wall 32 and extending inwardly from the front wall 32 towards the center of the base for a short distance, e.g., for about 0.310 inches. Similarly, a pair of facing hook-shaped wall sections 80*c*, 80*d* depend downwardly from the upper support surface 30 of the base 20 and open onto the rear base wall 34. Longitudinal slot spaces 82, 84 are defined between respective pairs of front and rear hook-shaped wall sections 80*a*, 80*c* and 80*b* and 80*d*. A lower slot wall 86 extends from the front base wall 32 to the rear base wall 34 from the inner ends of the hook-shaped wall sections 80 in a plane below the level of the upper support surface 30 of base 20. The upper surface 30 base 20 includes a pair of longitudinally extending upper slot flanges 88, 90 that project over the longitudinal slot spaces 82, 84 between the pairs of forward and rearward hook-shaped wall sections 80*a*, 80*c* and 80*b*, 80*d*. A pair of transverse raised ribs 92 are formed on the upper surface of the lower slot wall 86.

Figure 10A:
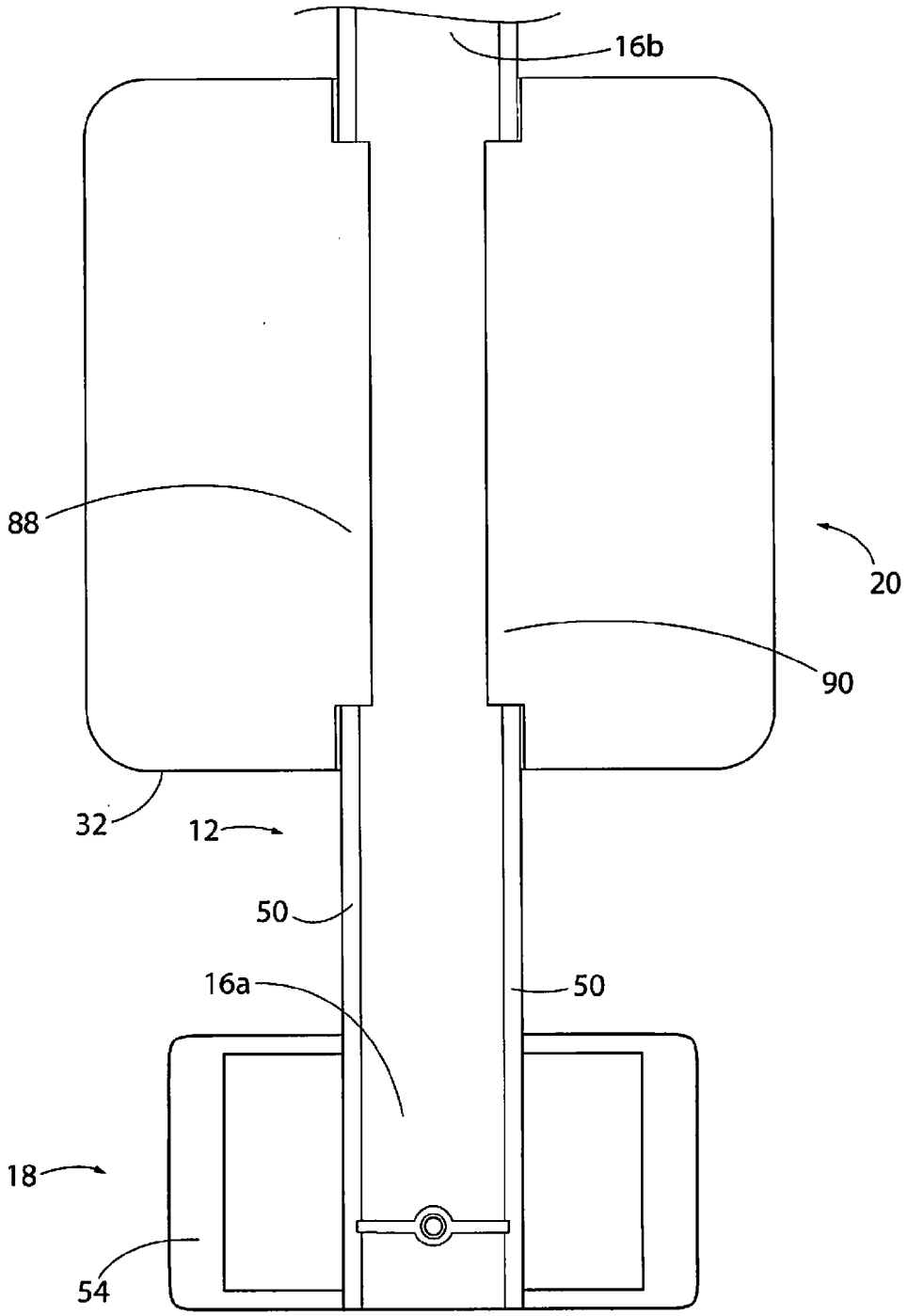
FIGS. 10*a* and 10*b* are top and bottom perspective views of the flexible shape-retaining elongate member (with the bracket of the sign assembly attached) and base of the embodiment of FIG. 1 coupled to each other.
Figure 10B:
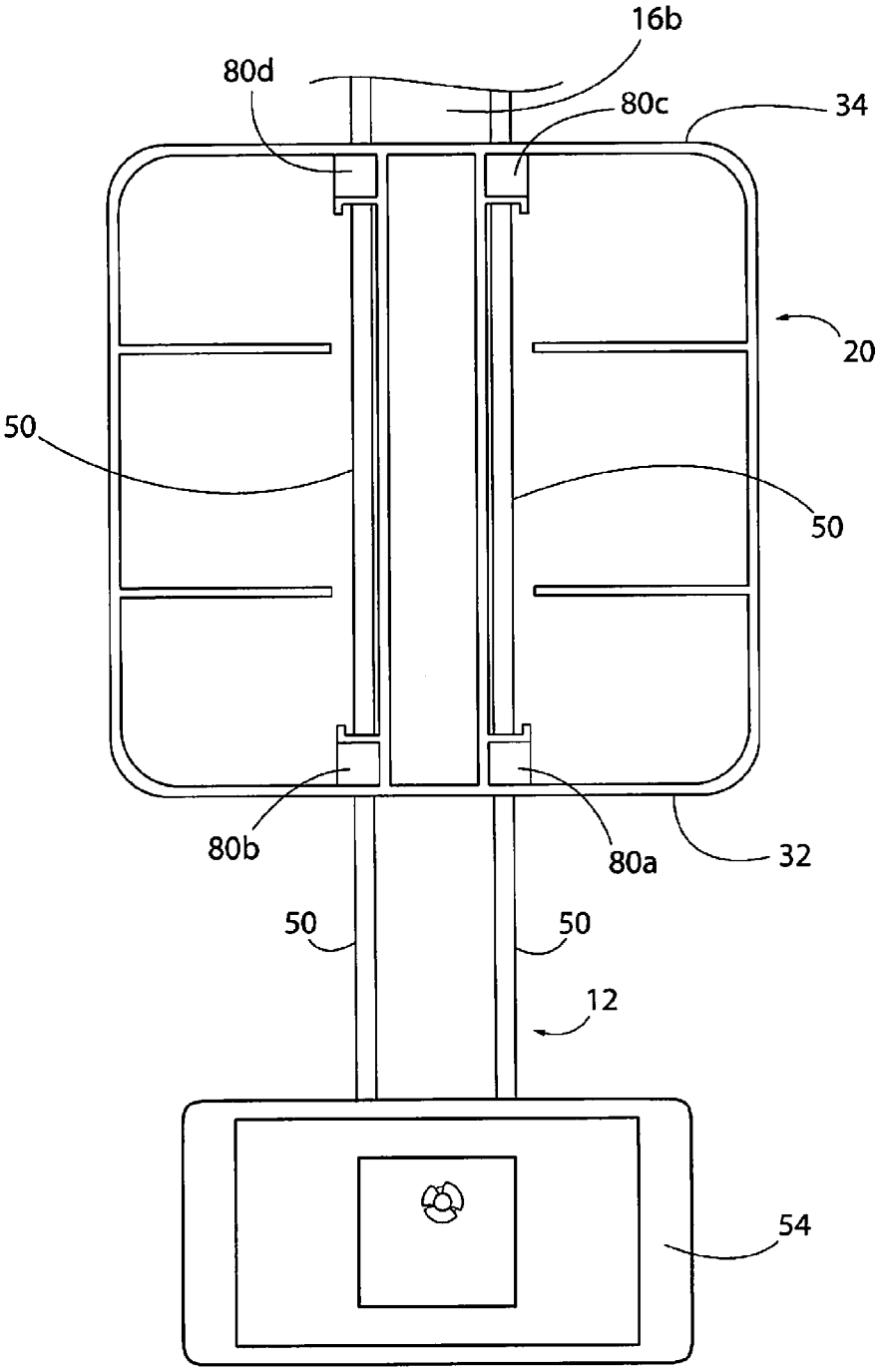
Figure 11:
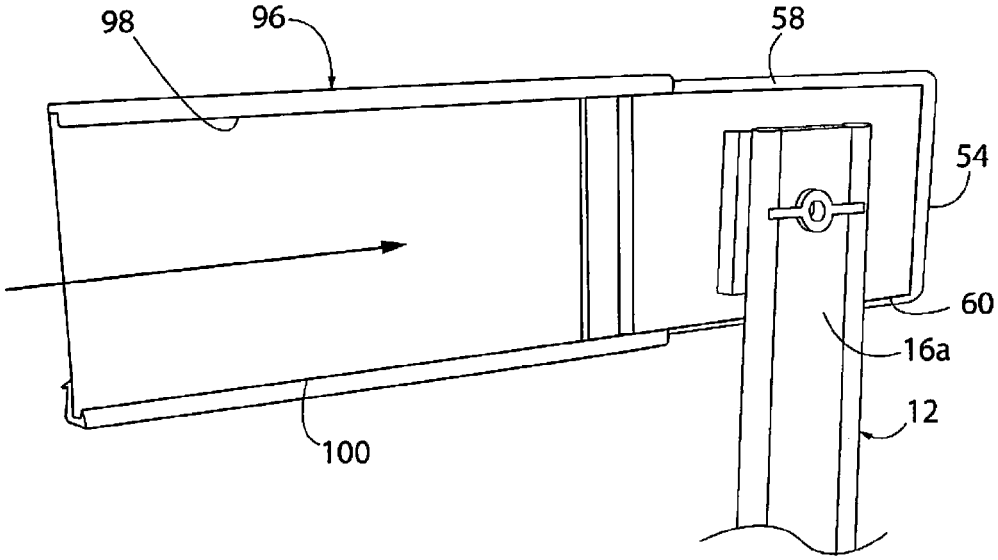
FIG. 11 is a rear perspective view illustrating the assembly of the sign member to the bracket of the sign assembly of the embodiment of FIG. 1.
Figure 12:
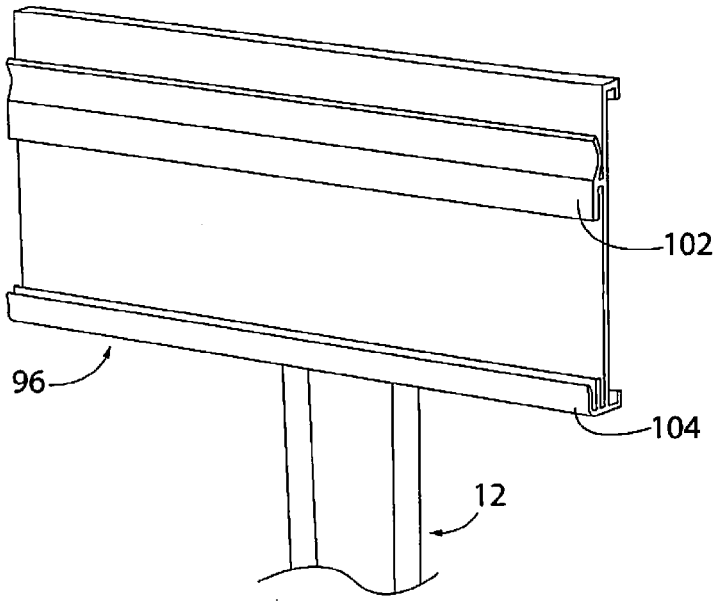
FIG. 12 is a front perspective view of the sign member assembled to the bracket of the sign assembly of the embodiment of FIG. 1.
Figure 13:
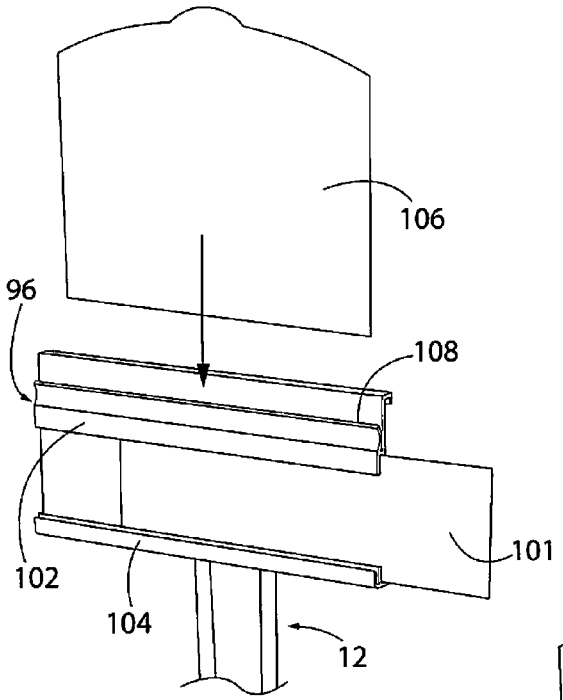
FIG. 13 is a perspective view illustrating the assembly of signs to the sign member of the embodiment of FIG. 1.
Figure 14:
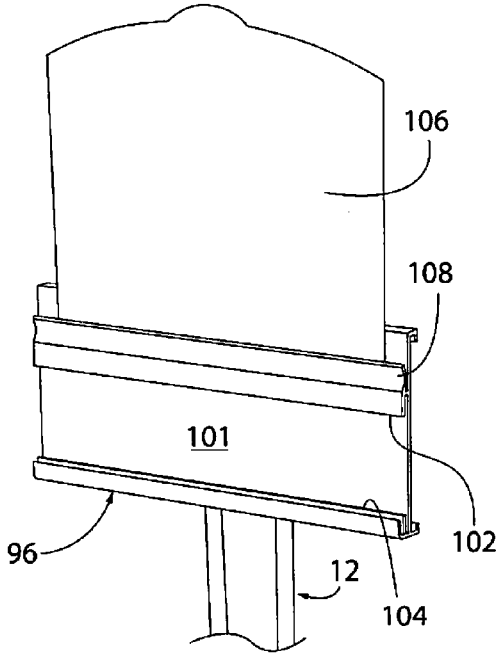
FIG. 14 is a front perspective view of the signs assembled to the sign member of the embodiment of FIG. 1.

The connection of the flexible shape-retaining elongate member 12 and the base 20 is described with particular reference to FIGS. 10*a* and 10*b*. Preferably, prior to connecting the elongate element 12 to the base 20, the bracket member 54 of the sign assembly 18 is coupled to the end portion 16*a* of the flexible shape-retaining elongate member 12 in the manner described above.

The free end portion 16*b* of the flexible, shape-retaining elongate member 12 is aligned with and longitudinally slidingly inserted into the end of slot 46 that opens onto the front wall 32 of base 20 so that each of the beaded side edge portions 50 of the elongate member 12 is aligned with a respective hook-shaped wall section 80*a*, 80*c* in the front wall 32 of base 20. Each of the beaded side edge portions 50 are bounded, guided and supported on its bottom and side by respective ones of the hook-shaped wall sections 80*a*, 80*b*. As insertion of the elongate member 12 into slot 46 continues, each of the beaded side edge portions 50 becomes bounded on the top and guided by the upper slot flanges 88, 90. As insertion continues, each of the beaded side edge portions 50 of the elongate element 12 becomes aligned with, bounded and guided on its bottom and side by a respective one of the hook-shaped walls 80*c*, 80*d* in the rear wall 34 of base 20. Finally, insertion is completed as the end portion 16*b* of the flexible shape-retaining elongate member 12 projects past the rear wall 34. The width of the slot 46, e.g., the distance between the vertical portions of the hook-shaped walls 80*a*, 80*b* in the front wall 32 of base 20 and the width of the flexible shape-retaining elongated member (including the beaded side edge portions 50) are chosen to provide a close fit in the width direction. The height of the slot 46, e.g., the distance between the bottom portion of the hook-shaped walls 80*a*, 80*b* in the front wall of base 20 and the lower surface of the upper slot flanges 88, 90, and the height of the beaded side portions 50 of the flexible shape-retaining elongate member 12 are chosen to provide a close fit in the height direction, effectively capturing the flexible shape-retaining elongate member 12 in the slot 46.

The dimensions are also chosen so that the flexible shape-retaining elongate member 12 will slide in its longitudinal direction in the slot when pulled from one side. At the same time, the dimensions are chosen to provide a sliding friction fit of the elongate member 12 in slot 46. In this connection, the height of the transverse ribs 92 formed on the lower slot wall 86 may be chosen to achieve a desired sliding friction fit, generally at least sufficient to prevent the elongate member 12 from falling out of the slot in a longitudinal direction (under gravity forces) and preferably from undesired longitudinal movement in the slot such as might be caused by placement of the product in association with the product centric merchandiser.

In advance of associating the product centric merchandiser with a product to be merchandised, the sign assembly 18 is completed. Referring to FIGS. 11-14 a frame member 96 is connected to the bracket member 54 by sliding upper and lower opposed channels 98, 100 on the rear of the frame member 96 over the upper and lower flanges 58, 60 of the bracket 54. A pricing sign 101 is slidingly received between a pair of upper and lower opposed sign channels 102, 104 on the front of the frame member 96 which capture the edges of the pricing sign. The lower edge of a product card 106 bearing information on the product is fixed in a card slot 108 to mount the product card to the product centric merchandiser.

Figure 15:
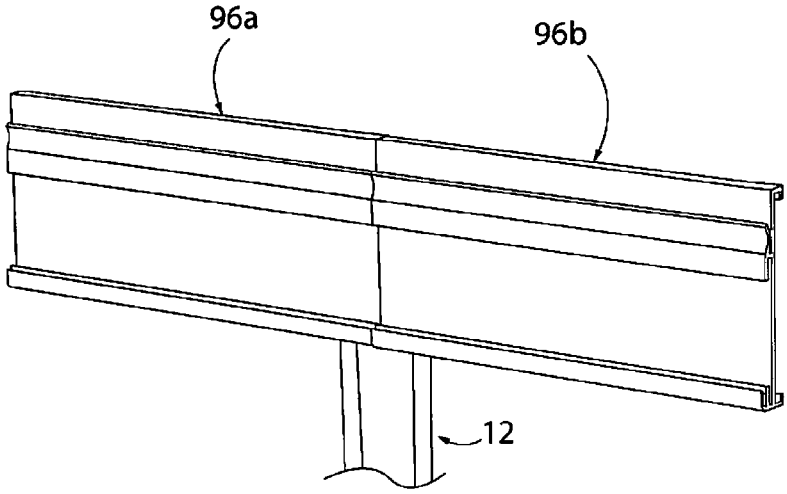
FIG. 15 is a perspective view of a sign assembly of a second embodiment of a product centric merchandiser according to the present invention in which two sign members are assembled to the bracket.
Figure 16:
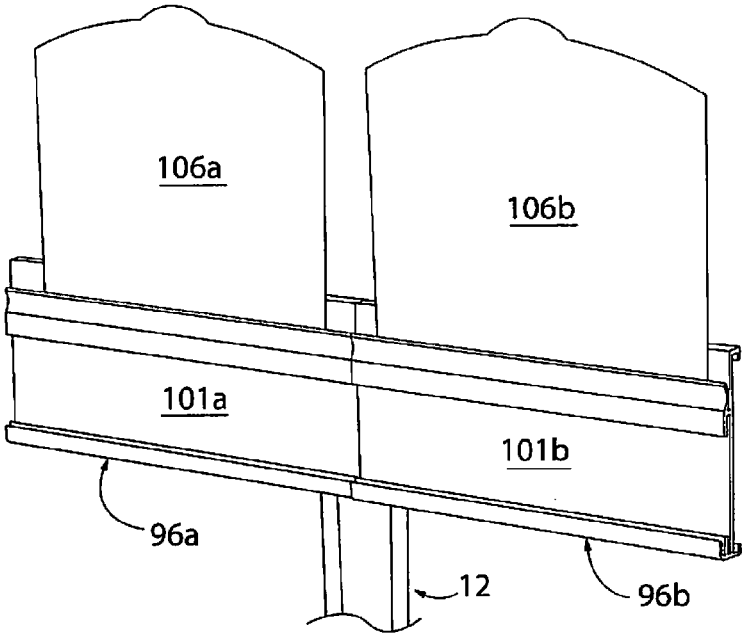
FIG. 16 is a front perspective view of signs assembled to the two sign members of the second embodiment of FIG. 15.

In another embodiment (FIGS. 15 and 16), a pair of frame members 96*a*, 96*b* are mounted to respective left and right portions of the bracket member 54 (not shown) to enable mounting two pricing signs 101*a*, 101*b* and product cards 106*a*, 106*b* to the product centric merchandiser.

Figure 17:
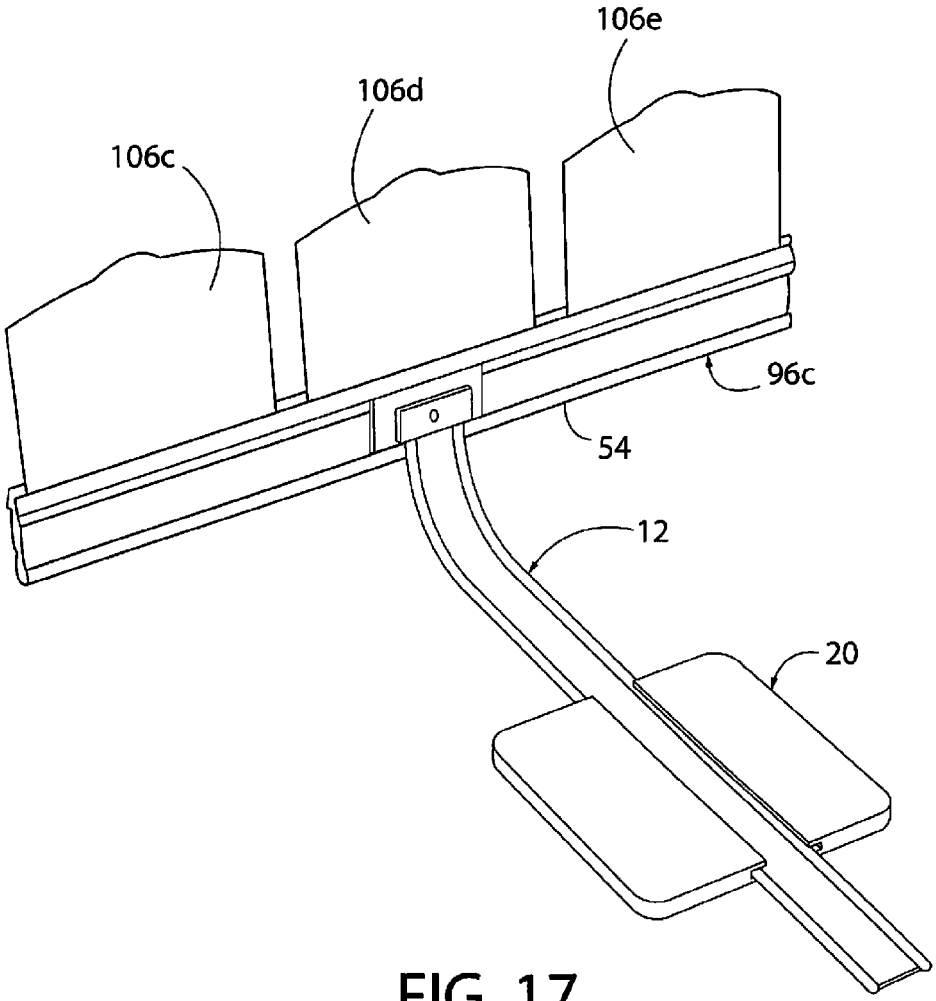
FIG. 17 is a rear perspective view of a third embodiment of a product centric merchandiser according to the present invention in which three sign members are assembled to a bracket of the sign assembly.
Figure 19:
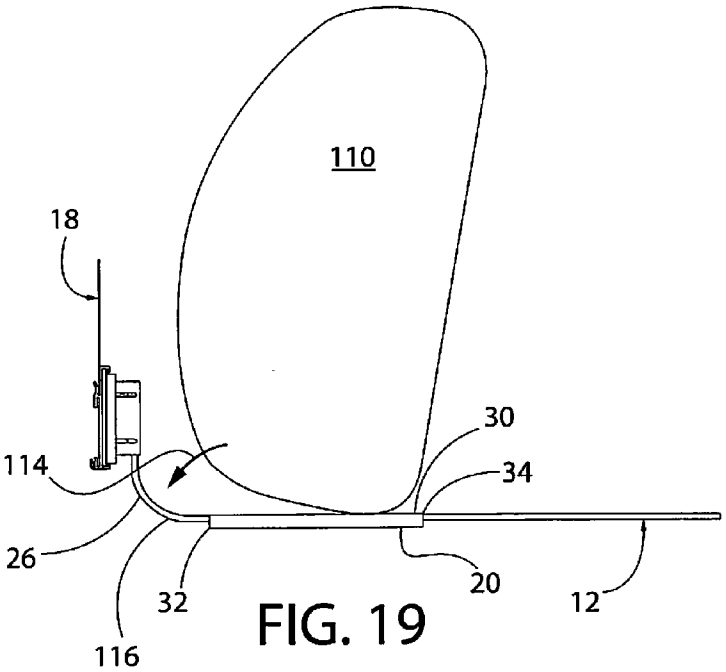
FIG. 19 is a side elevation view illustrating another step in associating a food product with the embodiment of the product centric merchandiser of FIG. 1 in which the flexible shape-retaining elongate member has been shaped to position the sign assembly in front of the product.

In another embodiment (FIG. 17), a longer frame member 96*c* is connected to the bracket member 54 which has a length sufficient to receive three product cards 106*c*, 106*d* and 106*e*.

Figure 20:
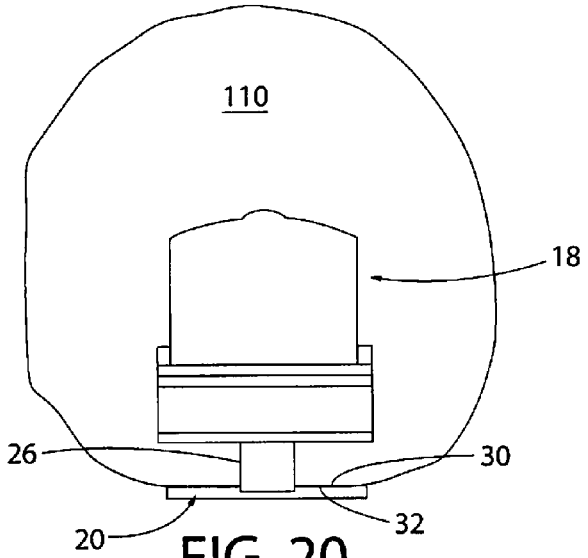
FIG. 20 is a front view of a food product associated with the embodiment of a product centric merchandiser of FIG. 1 in which the flexible elongate shape-retaining member is shaped to position the sign assembly in front of the product.
Figure 21:
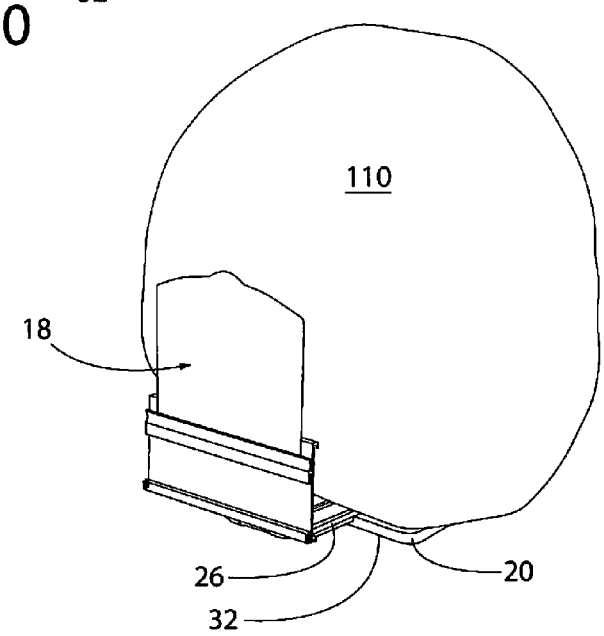
FIG. 21 is a perspective view of a food product associated with the embodiment of a product centric merchandiser of FIG. 1 in which the flexible elongate shape-retaining member is shaped to position the sign assembly in front of the product.

Referring to FIGS. 18-21, one manner of using the embodiment of the product centric merchandiser 10 of FIG. 1 is illustrated in which the product being merchandised is a ham 110 and in which the sign assembly 18 is positioned in front and at about the mid-height of the ham. As seen in FIG. 18, the flexible shape-retaining elongate member 12 in its rectilinear shape (i.e., prior to any bending or twisting) is positioned in the slot 46 of the base 20 along a connection region 22 which provides a post portion 26 with a length L which is sufficient such that when the post portion 26 is bent upwardly, the sign assembly 18 will be positioned in front of and at the mid-height of the ham 110. Prior to bending the elongate member 12, the ham 110 is situated on the upper surface 30 of base 20 as designated by arrows 112 and 114 in FIGS. 18 and 19. The post portion 26 is then bent at 116 to position the sign assembly in its desired position. When the ham 110 rests on the upper surface 30 of base 20 as shown in FIGS. 20 and 21, its weight holds the product centric merchandiser 10 in place and helps to prevent it from tipping over. Since the connection region 22 of the flexible shape-retaining elongate member 12 is situated below the plane of the upper surface 30 of base 20 and projects from the front and rear walls 32, 34 of the base, it does not interfere with the positioning of the ham 110 on the base, or with any additional sliding of the elongate member 12 in the slot 46 if further adjustment of the length L of post portion 26 is desired.

Figure 22:
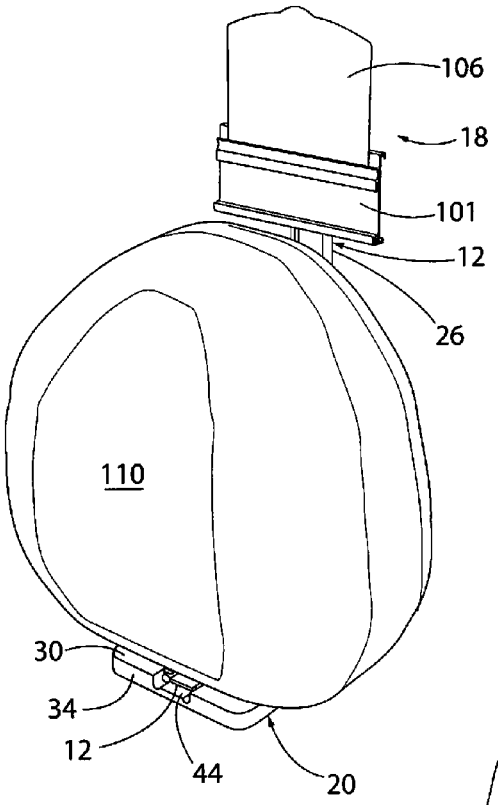
FIG. 22 is a perspective view of a food product associated with the embodiment of the product centric merchandiser of FIG. 1 oriented so that the flexible elongate shape-retaining member is shaped to position the sign assembly in back of and above the product.

FIG. 22 shows the product centric merchandiser 10 of FIG. 1 associated with a ham 110 in which the flexible shape-retaining elongate member 12 is oriented upside-down compared to the previously described embodiments so that the pricing sign 101 and the product card 106 of the sign assembly 18 face forwardly. Indeed, the slot structure 44 and elongate member 12 are designed in symmetrical fashion such that the elongate member can be slidingly received in the slot 46 either right side up or upside-down depending on the configuration of the product centric merchandiser relative to the product being merchandised. The length L of the post portion 26 is maximized (in this case) by suitably positioning the elongate member 12 in the slot 46.

Figure 23:
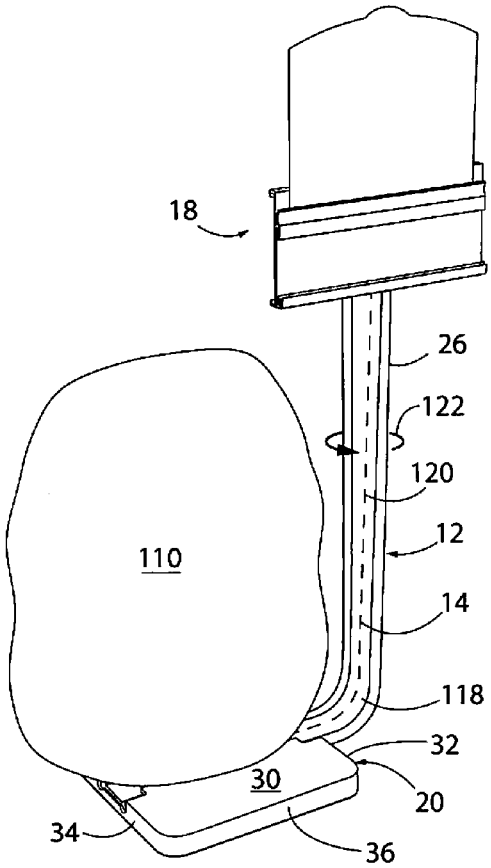
FIG. 23 is a perspective view of a food product associated with the embodiment of the product centric merchandiser of FIG. 1 oriented so that the flexible elongate shape-retaining member is shaped to position the sign assembly at a side of and above the product.

Referring to FIG. 23, the embodiment of the product centric merchandiser 10 of FIG. 1 is associated with a ham 110 in a manner such that the post portion 26 of the elongate member 12 is shaped to position the sign assembly 18 at a side and at the top of the ham 110. In this embodiment, the base 20 is situated so that the front wall 32 of the base faces the side to which the sign assembly 18 is to be located. The post portion 26 is vertical and the length L of the post problem 26 is maximized and bent at 118 and twisted at 120 (see arrow 122) around its longitudinal axis 14.

Figure 24:
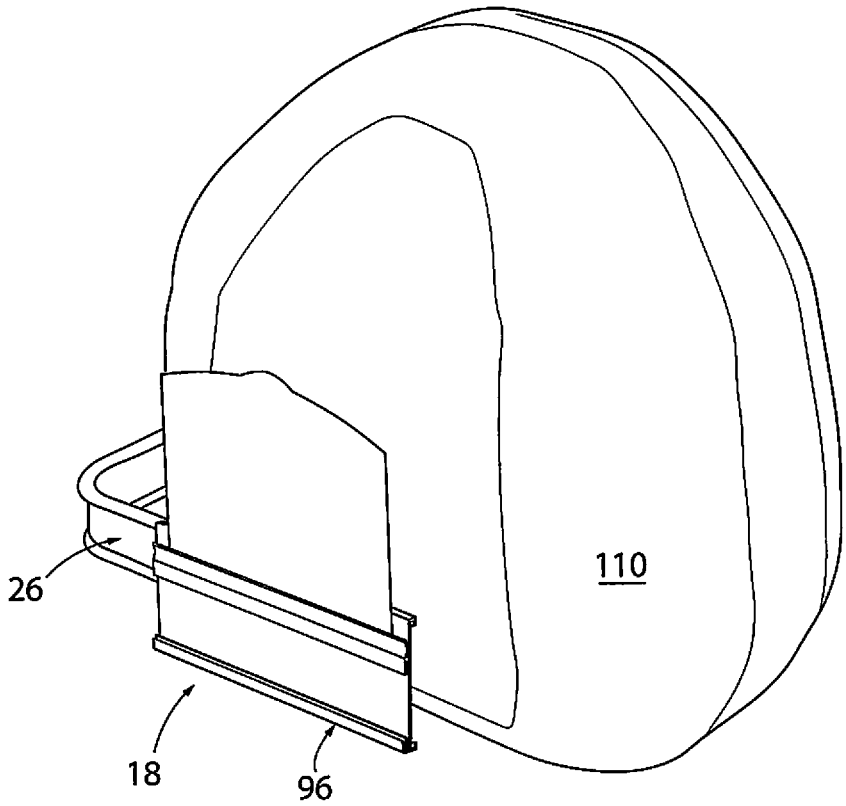
FIG. 24 is a perspective view of a food product associated with the embodiment of the product centric merchandiser of FIG. 1 oriented so that the flexible elongate shape-retaining member is shaped to wrap around a side of the product and position the sign assembly in front of the product, and wherein the sign assembly is rotated to align with the elongate member.

Referring to FIG. 24, the embodiment of the product centric merchandiser 10 of FIG. 1 is associated with a ham 110 in a manner such that the post portion 26 of the elongate member 12 is shaped to position the sign assembly 18 in front and at the mid-height of the ham 110. In this case, the post portion 26 is horizontal and is bent and twisted around the side of the ham 110. The post portion is twisted in back of the ham (not shown). Unlike the embodiments described above, the bracket member 54 and frame member 96 are rotated so as to extend substantially parallel to the longitudinal axis of the elongate member 12.

It is understood that the ways of bending and/or twisting the flexible shape-retaining elongate member 20 and the particular choice of the length L of the post portion 26 are not limited to those shown. The particular choice depends on parameters including how crowded the product display area may be, and the size of the product, among other things. In each case, the product being merchandised rests on the base 20 and its weight functions to prevent the merchandiser from tipping over in the case that the sign assembly is not situated vertically over the base.

Obviously, numerous modifications and variations of the present invention are possible in the light of the above teachings. For example, other configurations are possible for the elongate member than are specifically shown. It is therefore to be understood that within the scope of the claims appended hereto, the invention may be practiced otherwise than as specifically shown herein.

The invention claimed is:

1. A product centric merchandiser, comprising:

a flexible shape-retaining elongate member having a longitudinal axis and pair of longitudinal end portions;

a sign assembly coupled to one of said end portions of said flexible shape-retaining elongate member;

a base;

said flexible shape-retaining elongate member and base connected to each other at a connection region on the flexible shape-retaining elongate member by a connection arrangement such that a post portion of the flexible shape-retaining elongate member having a certain length is defined between the base and the sign assembly;

said connection arrangement configured such that the flexible shape-retaining elongate member and base are connectable at any one of a plurality of possible connection regions along the length of the flexible shape-retaining elongate member, each of the possible connection regions defining a respective post portion of the flexible shape-retaining elongate member having a certain length between the base and sign assembly which differs from the length of a post portion defined by another possible connection region and wherein said connection arrangement comprises a slot structure formed in the base defining a slot, and wherein said flexible shape-retaining elongate member has a transverse cross-sectional shape configured such that said flexible shape-retaining elongate member is slidingly received in said slot for movement in the direction of the longitudinal axis thereof, and wherein said base has an upper support surface on which a product to be associated with the product centric merchandiser is to rest, and wherein said base includes a front wall and a rear wall depending from said upper support surface and wherein such slot extends through said base below said upper support surface of said base and opens onto said front and rear base walls.

2. A product centric merchandiser as recited in claim 1 wherein said flexible shape-retaining elongate member is bendable and twistable with respect to the longitudinal axis thereof.

3. A product centric merchandiser as recited in claim 1 wherein said slot extends through said base substantially parallel to said upper support surface of said base.

4. A product centric merchandiser as recited in claim 1 wherein said flexible shape-retaining elongate member is slidingly received in said slot with a friction fit configured to prevent undesired sliding movement of said flexible shape-retaining elongate member in said slot.

5. A product centric merchandiser as recited in claim 1 wherein said sign assembly comprises a bracket member connected to said one of said end portions of said flexible shape-retaining elongate member.

6. A product centric merchandiser as recited in claim 1 wherein said flexible shape-retaining elongate member is strip-shaped.

7. A product centric merchandiser as recited in claim 6 wherein said strip-shaped flexible shape-retaining elongate member is formed of plastic material and includes a metallic wire embedded in said plastic material extending longitudinally through said strip-shaped flexible shape-retaining elongate member.

8. A product centric merchandiser as recited in claim 6 wherein said bracket member is rotatably connected to said one of said end portions of said flexible shape-retaining, strip-shaped elongate member.

9. A product centric merchandiser as recited in claim 8 wherein said sign assembly further comprises at least one frame member removably coupled to said bracket member.

10. A product centric merchandiser as recited in claim 6 wherein said strip shaped flexible shape-retaining elongate member comprises a pair of longitudinal beaded side edge portions.

11. A product centric merchandiser as recited in claim 10 wherein a metallic wire is situated within and extends longitudinally through each of said elongated beaded side edge portions.

12. A product centric merchandiser as recited in claim 6 wherein said strip-shaped flexible shape-retaining elongate member comprises a pair of longitudinal beaded side edges and a web between said beaded side edges.

13. A product centric merchandiser as recited in claim 12 wherein said slot is configured to receive and slidably capture said beaded side edges of the flexible shape-retaining elongate member.

14. A product centric merchandiser as recited in claim 12 wherein said strip-shaped flexible shape-retaining elongated member including said beaded side edges thereof is formed of plastic material and wherein a metallic wire is situated within and extends longitudinally through each of said elongated beaded side edge portions.

* * * * *